US006951479B1

(12) United States Patent
Wu

(10) Patent No.: US 6,951,479 B1
(45) Date of Patent: Oct. 4, 2005

(54) STACKED CONNECTOR ASSEMBLY HAVING A PAIR OF LATCH ARMS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 48 days.

(21) Appl. No.: 10/896,296

(22) Filed: Jul. 20, 2004

(51) Int. Cl.[7] ..... H01R 13/60
(52) U.S. Cl. ..... 439/541.5
(58) Field of Search ..... 439/541.5, 108–109, 439/63, 79–80, 570, 92, 252–253

(56) References Cited

U.S. PATENT DOCUMENTS 5,531,612 A 7/1996 Goodall et al.
5,761,805 A 6/1998 Guyer
5,766,033 A 6/1998 Davis
6,071,149 A * 6/2000 Hara ..... 439/607
6,183,273 B1 * 2/2001 Yu et al. ..... 439/92
6,193,547 B1 * 2/2001 Tung ..... 439/541.5
6,227,904 B1 * 5/2001 Wang et al. ..... 439/541.5
6,524,130 B1 * 2/2003 Yeh ..... 439/541.5
6,736,676 B2 * 5/2004 Zhang et al. ..... 439/607

* cited by examiner

*Primary Examiner*—J. F. Duverne
(74) *Attorney, Agent, or Firm*—Wei Te Chung

(57) ABSTRACT

A stacked connector assembly (100) includes a pair of sub-connectors (1, 2), a numeral of contacts (3) received in the housing (10, 20) of the sub-connectors, a cable (4) terminated to the contacts, a cover (7) over-molded with the housing and the cable and defining a pair of receiving spaces (71, 72) therein, and a pair of latch arms (6) in a mirror-imaged arrangement. The latch arm includes a retaining portion (61) secured with the insulative housing of corresponding sub-connector, a supporting portion (64) engaged with the cover, a pressing portion (63) between the retaining portion and the supporting portion, and a pair of latch tabs (620) located close to the retaining portion.

12 Claims, 5 Drawing Sheets

STACKED CONNECTOR ASSEMBLY HAVING A PAIR OF LATCH ARMS

BACKGROUND OF THE INVENTION

1. Field of the Invention

The present invention generally relates to a stacked connector assembly, and more particularly to a stacked connector having a pair of latch arms.

2. Description of Prior Art

There exits in the art an electrical connector known as a serial Advanced Technology Attachment (serial ATA) connector which is generally used for disk drives and storage peripherals. Especially, the serial ATA connector according to the serial ATA standard are featured in fewer electrical contacts than other conventional electrical connectors and are relatively tiny in configuration.

Nowadays, not only are processor speeds increasing, but also the amount of space that a computer fits into is shrinking. Therefore, the motherboards or printed circuit boards (PCBs) that hold the electronics and other devices for a computer have limited space. In a computer which may contain multiple hard drives, multiple serial ATA connectors and serial ATA cable assemblies may need to be stacked with each other for saving the space. For ensuring each serial ATA connector retaining on the complementary connector, a latch is usually formed on the serial ATA connector. Suppose, the latch is assembled on the top wall of the stacked serial ATA connector, the complementary connector matching with the lower connector of the serial ATA connector can not be retained by the latch. The same problem should happen if the latch assembled on the lower wall of the stacked serial connector.

Hence, a stacked connector has an improved latch to overcome the disadvantages of the prior art.

BRIEF SUMMARY OF THE INVENTION

Accordingly, the object of the present invention is to provide a stacked connector assembly having a latch for locking/unlocking the cable end connector assembly with/from a complementary connector more conveniently.

In order to achieve the above-mentioned object, a stacked connector assembly comprises a cover defining at least two receiving spaces, a pair of sub-connectors each received in corresponding receiving spaces, each sub-connector connected with a cable. Each sub-connector further comprises a latch arm. The latch arms of the sub-connectors are arranged in a mirror-imaged arrangement.

Other objects, advantages and novel features of the invention will become more apparent from the following detailed description of the present embodiment when taken in conjunction with the accompanying drawings.

DETAILED DESCRIPTION OF THE INVENTION

Figure 1:
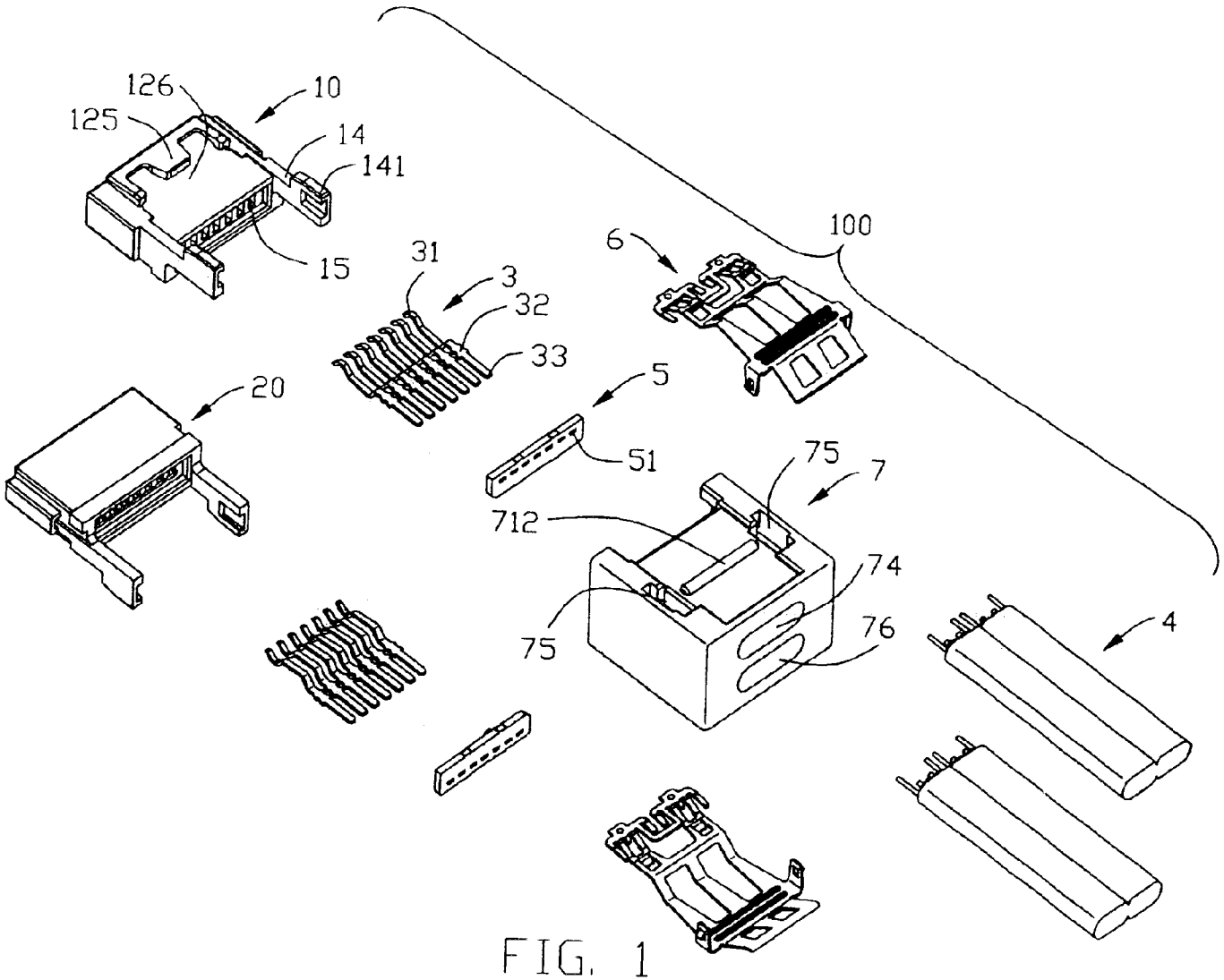
FIG. 1 is an exploded, perspective view of a stacked connector assembly in accordance with the present invention.

Reference will now be made to the drawing figures to describe the present invention in detail.

Figure 2:
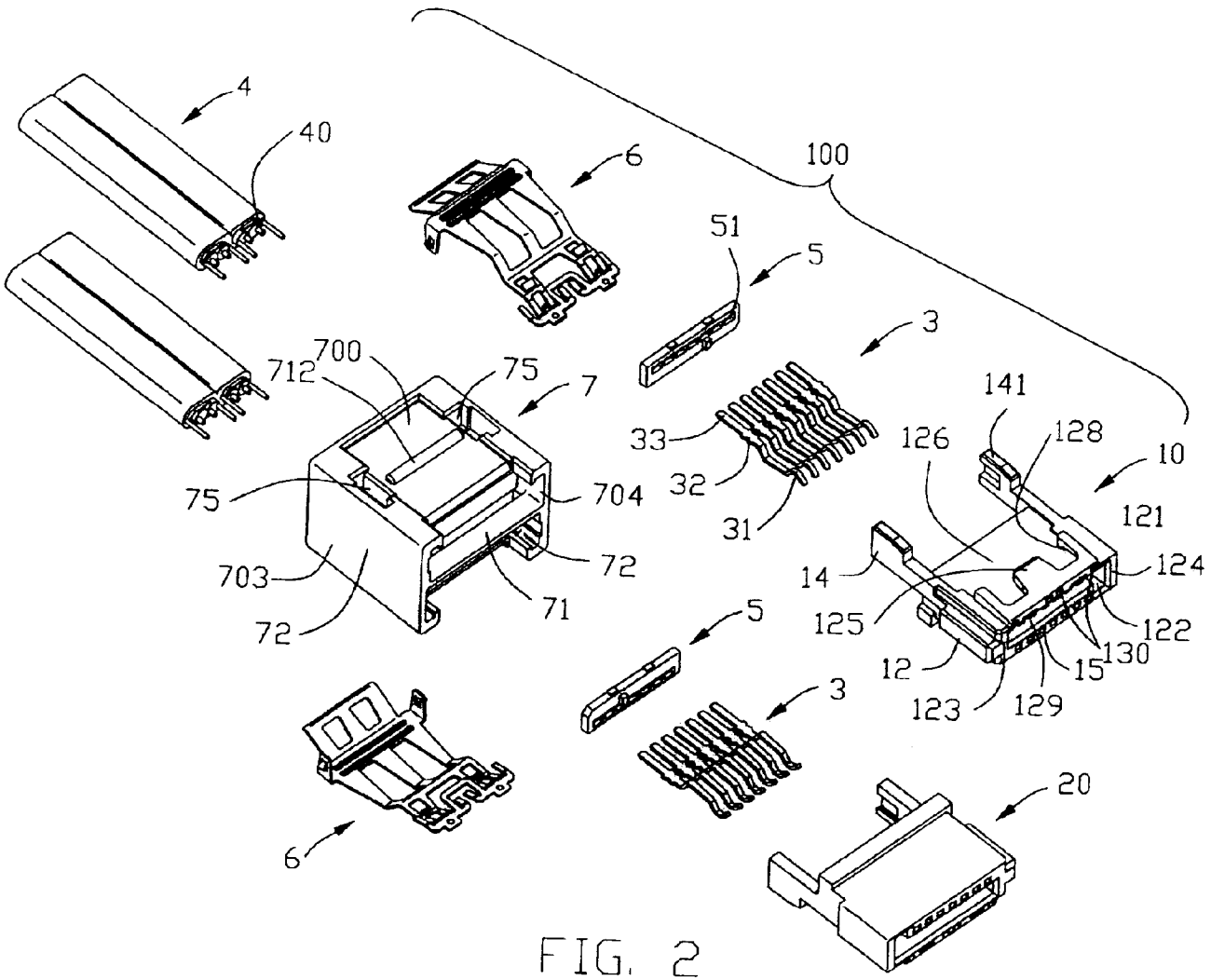
FIG. 2 is a view similar to FIG. 1, but taken from a different aspect.

Referring to FIGS. 1 and 2, a stacked connector assembly 100 in accordance with the present invention comprises a first sub-connector 1 and a second sub-connector 2, a cover 7, a plurality of contacts 3, two cables 4, two spacers 5 and a pair of latch arms 6.

The first sub-connector 1 comprises a first insulative housing 10. The insulative housing 10 comprises a base portion 12, and a pair of guiding posts 14 extending backwardly and vertically along the opposite sides of the base portion 12 and beyond the rear end of the base portion 12. The base portion 12 comprises an upper wall 121, a lower wall 122 opposite to the upper wall 121, and a pair of sidewalls 123, 124 connecting with the upper wall 121 and the lower wall 122. The upper wall 121, the lower wall 122 and the sidewalls 123, 124 together define an L-shaped interface therebetween for matching with complementary connector (not shown). The lower wall 122 of the base portion 12 defines a plurality of passageways 15 extending therethrough along a front-to-back direction. The upper wall 121 of the base portion 12 defines a depression 126 in an upper surface thereof. A flat portion 125 protrudes upwardly and rearwardly from a middle portion of a front flange of the upper wall 121 into the depression 126. A gap 128 is formed between the flat portion 125 and a bottom surface of the depression 126. The upper wall 121 further defines a pair of first slots 129 and two pairs of second slots 130 in communication with the gap 128. Each guiding post 14 defines a free end 141 with a cutout 1410 thereon.

The second sub-connector 2 comprises a second insulative housing 20 has the same structure as the first insulative housing 10.

The cover 7 comprises a rectangular body portion 70. The body portion 70 is formed with a top wall 700, an opposite bottom wall 702, a pair of side walls 703, 704 parallelly extending between the top and the bottom walls 700, 702, and a rear wall 705 connecting the top, the bottom and the side walls. A first and a second receiving space 71, 72 are parallelly arranged in an upper and lower manner between the top and the bottom walls 700, 702 for receiving corresponding sub-connector 1, 2. A pair of passages 75 are defined at opposite sides of the top wall 700 extending from the top wall 700 to the bottom wall 702 in communication with receiving spaces 71, 72 for receiving corresponding free end 141 of the guiding posts 14. A first channel 74 and a second channel 76 are defined on the rear wall 705 of the body portion 70 and communicating with corresponding receiving space 71, 72. The top wall 700 further comprises a holding bar 712. The bottom wall 702 has the same structure as the top wall 700.

The contacts 3 are respectively disposed in the passageways 15 of the first and the second insulative housing 10, 20. Each of the contacts 3 comprises a curved contact portion 31 exposed in a corresponding passageway 15 of the insulative housing 10, 20, a retention portion 32 engaged with interior sides of the corresponding passageway 15, and a tail portion 33 perpendicularly bent from the retention portion 32.

The cable 4 comprises a plurality of individual conductors 40 for being respectively soldered to the tail portions 34 of the contacts 3.

The spacers 5 are respectively mounted to the rear end of the first and second insulative housings 10, 20 and each defines a plurality of through hole 51 only allowing the tail portions 33 of the contacts 3 passing therethrough. The spacer 5 can prevent plastic from seeping into the passageways 15 of the first and second insulative housing 10, 20 during the molding process of the cover 7. The contacts 3 and the spacer 5 can be integrally formed before mounting to the first and second insulative housing 10, 20, if desired.

Figure 3:
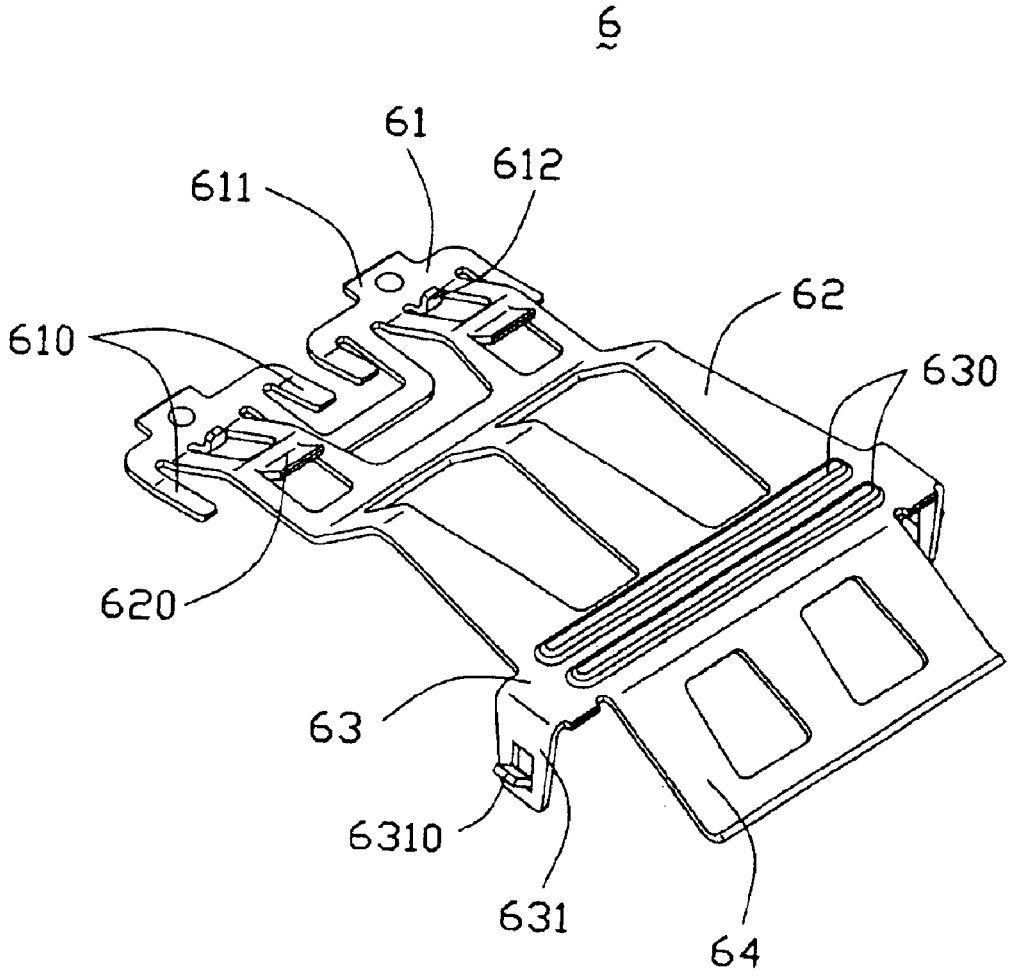
FIG. 3 is an enlarged, perspective view of a latch arm shown in FIG. 1.

Particularly referring to FIG. 3, each of the latch arm 6 is stamped and formed from a metallic plate and comprises a retaining portion 61, a locking portion 62 extending upwardly and rearwardly from the retaining portion 61, a pressing portion 63 extending rearwardly from the locking portion 62, and a supporting portion 64 extending rearwardly and downwardly from the pressing portion 63. The retaining portion 61 has two pairs of snap tabs 610 extending rearwardly and upwardly from a front end thereof, a pair of forwardly extending positioning tabs 611, and a pair of upwardly protruding curved stopping portions 612. The locking portion 62 has a pair of latch tabs 620 protruding upwardly and rearwardly therefrom. The pressing portion 63 is formed with two holding ribs 630 on a top surface thereof, and a pair of side beams 631 extending downwardly from opposite ends thereof. Each side beam 631 is stamped with a spring tab 6310 extending outwardly therefrom.

In assembly, the individual conductors 41 of the cable 4 are soldered to the tail portions 33 of the contacts 3, and extend through the first channel 74 and the second channel 76 into the first and second receiving spaces 71, 72. The guiding posts 14 of the first and second housings 10, 20 are partially and respectively received in corresponding receiving spaces 71, 72, and the free ends 141 partially exposed beyond the passages 75.

Figure 4:
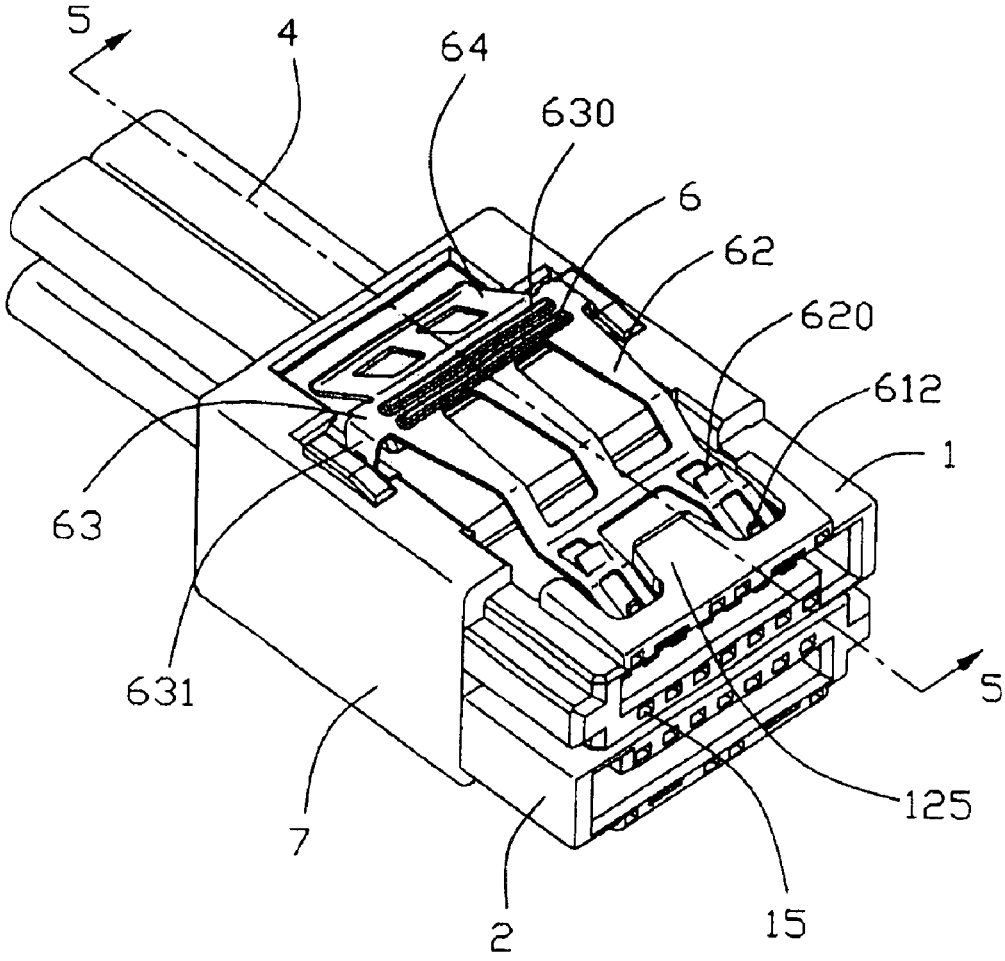
FIG. 4 is an assembled view of the cable end connector assembly shown in FIG. 1.
Figure 5:
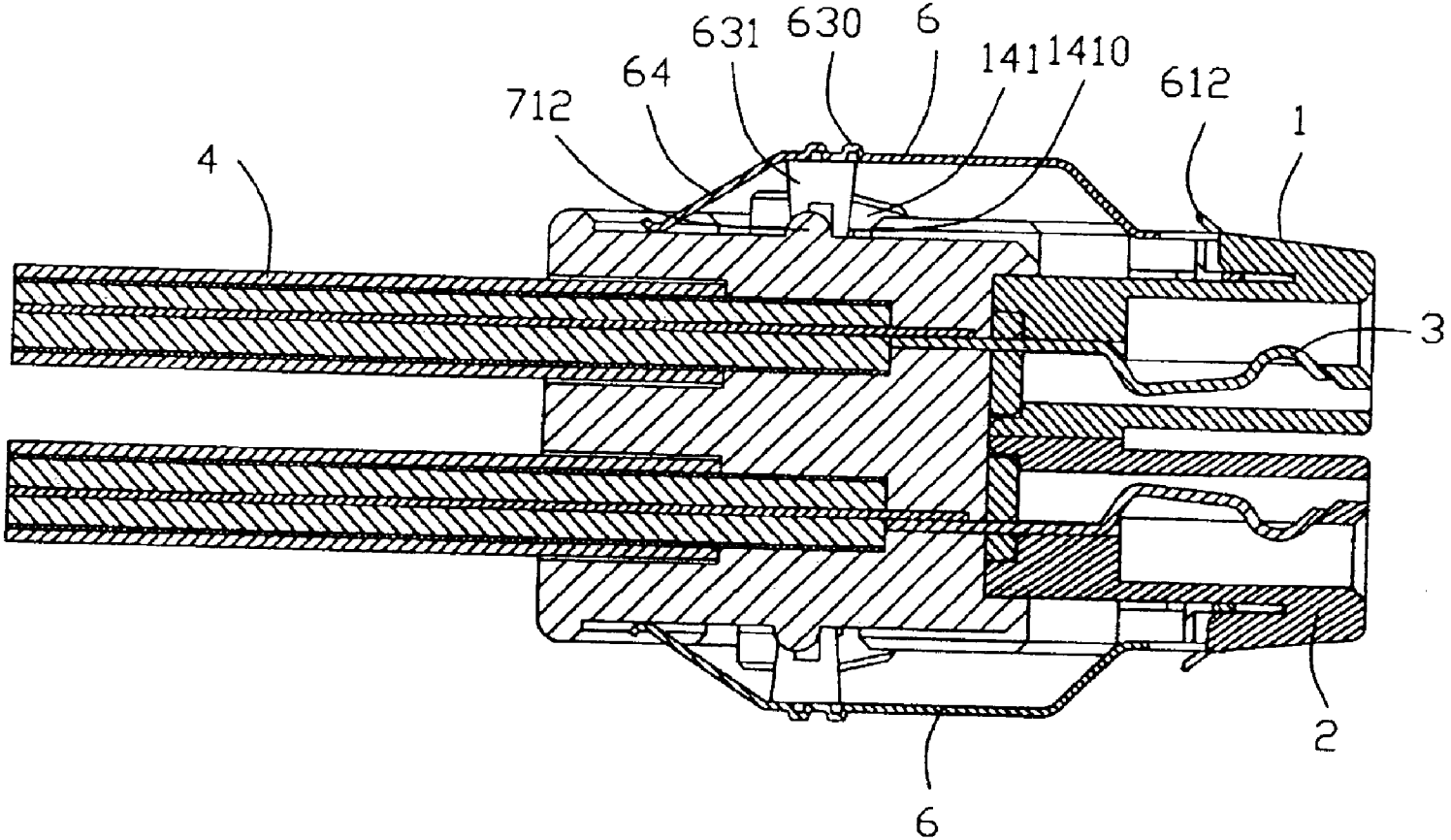
FIG. 5 is a cross-sectional view taken along line 5—5 of FIG. 4.

Particularly referring to FIGS. 4 and 5, one of the latch arms 6 is mounted onto the first sub-connector 1 and the top wall 700 of the cover 7. The latch arm 60 is then assembled to the cover 7 and the first insulative housing 10 under a pressing force, with the side beams 631 thereof respectively partially inserted into the rear portions of the passages 75 and pushed adjacent to the free end 141 of the first insulative housing 10, with the positioning tabs 611 and the snap tabs 610 of the retaining portion 61 respectively pushed into the gap 182 and received in the corresponding first and second slots 129, 130 of the first insulative housing 10, and with the supporting portion 64 abutting against the top surface of the top wall 121 of the first insulative housing 10. The spring tabs 6310 of the pressing portion 63 are pressed into the cutouts 1410 of the guiding posts 14 and are slideable therealong. The latch arm 6 assembled on the bottom wall 702 of the cover 7 follows the same means of the latch arm 6 assembled on the top wall 700 of the cover 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked connector assembly comprising:

a cover defining at least two receiving space;

a pair of sub-connector each received in corresponding receiving spaces, each sub-connector connected with a cable; and each sub-connector further including a latch arm such that those latch arms being arranged in a mirror-imaged arrangement; wherein the latch arm comprises a retaining portion, a locking portion extending from the retaining portion, a pressing portion extending from the locking portion, and a supporting portion extending from the pressing portion; wherein the retaining has two pairs of snap tabs extending from a front end thereof, a pair of positioning tabs, and a pair of upwardly protruding stopping portions; wherein the pressing portion is formed with a holding rib on a top surface thereof, and a side beam extends downwardly from one of opposite ends thereof, the side beam has a spring tab.

2. The stacked connector assembly as claimed in claim 1, wherein the sub-connectors have the same structure with each other.

3. The stacked connector assembly as claimed in claim 1, wherein the receiving spaces are parallel to each other.

4. The stacked connector assembly as claimed in claim 1, wherein each of the sub-connectors defines a L-shaped interface thereon.

5. The stacked connector assembly as claimed in claim 1, wherein each of the sub-connectors comprises a base portion and a pair of guiding posts extending along opposite sides of the base portion and received in corresponding receiving space.

6. The stacked connector assembly as claimed in claim 5, wherein each guiding post of the sub-connectors has a free end, and wherein the cover defines two pairs of passages at opposite sides of a top wall and a bottom wall thereof, respectively, each free end of guiding post is received in a corresponding passage.

7. The stacked connector assembly as claimed in claim 5, wherein the base portions of the sub-connectors each comprises a plurality of passageways for receiving corresponding contacts.

8. The stacked connector assembly as claimed in claim 1, further comprising two spacers respectively mounted on rear ends of the sub-connectors and each defining a plurality of through holes, and wherein each contacts comprises a tail portion passing though a corresponding through hole of the spacers.

9. The stacked connector assembly as claimed in claim 1, wherein the locking portion has a pair of latch tabs.

10. A stacked connector assembly comprising:

a pair of stacked sub-connectors having thereof respective rear portions commonly embedded within a single cover;

a pair of cables connected to the rear portions of the corresponding sub-connectors, respectively; and each of said pair of sub-connectors further including a latch arm with thereof a front end section associated thereto and a rear end section associated with the cover; wherein the latch arms of said pair of sub-connectors are deflectable toward each other; wherein said latch arms of said pair of sub-connectors are located on two opposite sides of the cover; wherein the latch arm comprises a retaining portion, a locking portion extending from the retaining portion, a pressing portion extending from the locking portion, and a supporting portion extending from the pressing portion; wherein the retaining portion has two pair of snap tabs extending from a front end thereof, a pair of positioning tabs, and a pair of upwardly protruding stopping portions.

11. The assembly as claimed in claim 10, wherein at least one of said front end section and said rear end section is moveable.

12. A stacked connector assembly comprising:

a pair of stacked upper and lower sub-connectors having thereof respective rear portions commonly embedded within a single cover;

a pair of cables connected to the rear portions of the corresponding sub-connectors, respectively; and said pair of sub-connector respectively defining pair of mating ports in corresponding front portions thereof, wherein the mating port of the lower sub-connectors is similar to that of the upper sub-connectors while in an upside-down manner, and the assembled sub-connectors with the associated cover form a joined piece for operation:

wherein said pair of cables are commonly integrally bound to said single cover;

a pair of latch arms are located on two opposite sides of the cover in a vertical direction; wherein the latch arm comprises a retaining portion, a locking portion extending from the retaining portion, a pressing portion extending from the locking portion, and a supporting portion extending from the pressing portion; wherein the retaining portion has two pairs of snap tabs extending from a front end thereof, a pair of positioning tabs, and a pair of upwardly protruding stopping portions.

* * * * *